US005329834A

United States Patent [19]

Wong

[11] Patent Number: 5,329,834

[45] Date of Patent: Jul. 19, 1994

[54] MULTI-ANGLE ALL-PURPOSE RATCHET SCREWDRIVER

[76] Inventor: Jason Wong, 28-2, Lane 232, Hu-Lin Street, Taipei, Taiwan

[21] Appl. No.: 71,860

[22] Filed: Jun. 7, 1993

[51] Int. Cl.[5] ..... B25B 13/06; B25G 1/08; B25G 1/06

[52] U.S. Cl. ..... 81/58.3; 81/177.8; 81/177.4; 81/490; 81/439

[58] Field of Search ..... 81/58.3, 58.4, 177.8, 81/177.1, 177.9, 177.4, 177.7, 489, 490, 437, 438, 439

[56] References Cited

U.S. PATENT DOCUMENTS 4,934,223 6/1990 Wong ..... 81/490
4,971,156 11/1990 Wong ..... 173/12

*Primary Examiner*—D. S. Meislin
*Attorney, Agent, or Firm*—Nikaido, Marmelstein Murray & Oram

[57] ABSTRACT

The invention herein relates to a kind of multi-angle all-purpose ratchet screwdriver that consists mainly of a serrated ratchet wheel on a screwdriver chuck, a ratchet-angle locking plate at the hinged juncture between the handle and the screw driver chuck, and a threaded positioner plate which, when tightened, exerts pressure on the ratchet wheel and the ratchet-angle locking plate, thus, securing the ratchet-angle locking plate against the ratchet wheel on the screwdriver chuck, while also attaining the objective of securing the ratchet-angle locking plate to the screwdriver chuck at various angles. Furthermore, there is a removable accessories holder inside the handle that is secured by a guide seat held against the accessories holder by a snap-fit fast-open cover, which allows the quick removal and replacement of the cover by simply pulling or pushing, and the accessories holder below can then be naturally slid out of the handle, without falling out unnecessarily, to attain the objective of changing screwdriver accessories.

14 Claims, 3 Drawing Sheets

MULTI-ANGLE ALL-PURPOSE RATCHET SCREWDRIVER

FIELD OF THE INVENTION

The present invention relates to a multi-angle all-purpose ratchet screwdriver.

BACKGROUND OF THE INVENTION

Based on the structural design of conventionally utilized adjustable-angle screwdrivers, most can only be firmly adjusted at two to three angles. Typically the usable adjustments are limited to perpendicular, straight or 45-degree angles. However, with regard to elaborate precision designed and exact assembled machine parts or mechanical devices, screwdrivers with these limited angles are completely unusable. Moreover, with regard to certain specific mechanical devices, if the product has few additional functions, or even no additional functions, then its relative added value is reduced and its relative natural market competitiveness is lowered. Unless there is low price cut-throat sales, adapting to market conflicts will be impossible.

SUMMARY OF THE INVENTION

In view of the aforementioned shortcomings and raising the number of additional functions in a product, the inventor gradually over many years accumulated extensive experience in the construction and sales of mechanical hardware and tools, continuously innovating and improving, while undergoing repeated testing and design, culminating in the successful development of a kind of multi-angle all-purpose ratchet screwdriver. Moreover, the invention herein can be said to be an improvement of the inventor's Pat. No. 4,934,223 and No. 4,971,156. The present invention constitutes a further innovative device consisting mainly of the utilization of a ratchet-angle locking plate enmeshed on the ratchet wheel of the screwdriver chuck and a cotter plate which secures the ratchet-angle locking plate in place through pressure, and these have enabled the attainment of the objective of multi-angular adjustment and sturdiness in use. Furthermore, there is a removable accessories holder inside the handle and also a snap-fit cover rapidly removable or replaceable by hand which enables the accessories holder to be quickly slid out from the handle, thus attaining the objective of changing screwdriver tools.

DESCRIPTION OF THE PREFERRED EMBODIMENTS

The accompanying drawings that illustrate in detail the unique structure, assembly and sought objectives of the invention herein shall be described below to permit a more thorough understanding of the usefulness of the invention herein.

Figure 1:
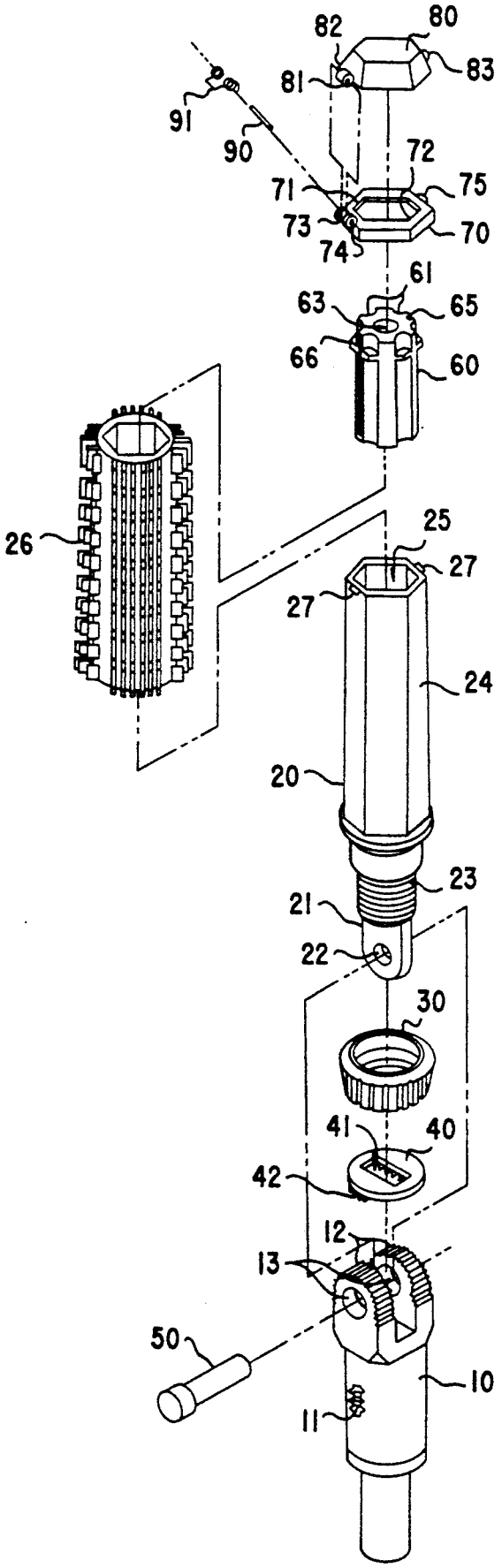
FIG. 1 is an exploded structural drawing of the invention herein.

As indicated in FIG. 1, the main structural components of the invention herein include:

A screwdriver chuck is similar to conventional components of this type, in that it is mainly utilized to provide an attachment that holds different size screwdriver tips (screwdriver tools). There is a directional stop button (11) on the chuck (10) that can be adjusted for clockwise or counter-clockwise rotation. Between the chuck (10) and a handle (20) is a hinge section that is U-shaped in design. There are serrations arrayed in multi-angular fashion on the tops two vertical arms of the U-shaped hinge section which comprise a ratchet wheel (12). Bored through a side of each aforesaid vertical arm is a shaft hole (13) provided to accommodate the insertion of a shaft rod (50) which joins the chuck (10) to the handle (20).

At one end of the aforesaid handle (20) is a hinge tab (21) with a shaft hole (22). The hinge tab (21) is inserted into the recess of the multi-angle ratchet wheel (12) and the shaft hole (22) is provided for the insertion and hinging of the aforementioned shaft rod (50), thus forming a movable pivot point. There is a threaded section (23) immediately above the hinge tab (21). The threaded section (23) serves as the main means for tightening a positioner plate (30) by rotating. Above the threaded section (23) is a grip section (24). The grip section (24) is of a hexagonal tubular design forming a space (25) on the inside. A non-slip rubber sleeve (26) is fitted over the outer surfaces of the grip section to enable convenient gripping by a hand. On the upper external end of the grip section (24), there are lock tabs (27) in parallel juxtaposition which keep a guide seat (70) firmly inserted.

The positioner plate (30) is slightly conical in shape with a fluted exterior design to increase surface friction and a threaded interior design so that the positioner plate (30) can be screwed onto the threaded section (23) of the aforementioned handle (20) by rotating freely on the threaded section (23).

A ratchet-angle locking plate (40) is in the shape of a disk with a rectangular slot (41) through which the hinge tab (21) of the handle (20) is inserted. Where the ratchet-angle locking plate (40) contacts the end of the screwdriver chuck (10) are two rows of toothed ridges (42). These toothed ridges (42) mesh exactly with cogs of the multi-angle ratchet wheel (12).

The shaft rod (50) serves mainly to hinge the screwdriver chuck (10) to the handle (20), enabling the aforesaid chuck and handle to be conjoined into a single unit that is capable of pivotal movement.

Figure 2B:
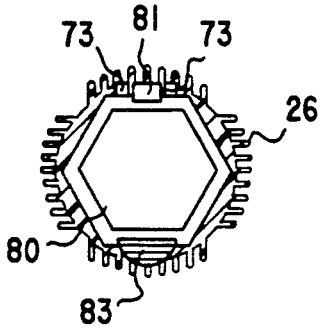
FIG. 2A is a cross-sectional drawing of the invention herein and FIG. 2B is a top view.
Figure 2A:
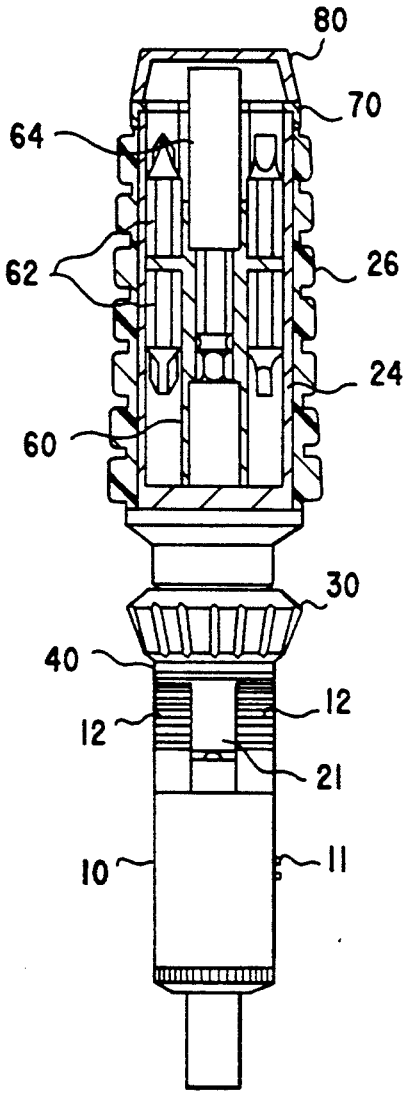

An accessories holder (60) is of a hexagonal columnar design with semi-circular troughs (61) on the sides for the secure insertion of different size screwdriver tips (62) (FIG. 2A). There is a storage hole (63) in the center of the accessories holder (60) for the placement of an extension rod (64) (FIG. 2A). To the left and right sides of the center line on the sides of the accessories holder (60) are guide grooves (65) and (66). The guide grooves (65) and (66) are mainly a means for alignment and tracking of guide tabs (71) and (72) on a guide seat (70), thus facilitating expansion and contraction which keeps the accessories holder (60) held firmly in place.

The guide seat (70) is of a hexagonal ring-shaped seat design that relies mainly on a slip-fit method for securing onto the lock tabs (27) on the upper end of the handle (20). On the inside of the guide seat (70) are the two oppositely positioned guide tabs (71) and (72) which are mainly provided for insertion into the aforementioned two guide grooves (65) and (66). On an end outside of the guide seat (70) is a seat lock (73). The seat lock (73) has a curved hole (74) for the insertion of a cotter pin (90) and spring (91). On the opposite end is a securing tab (75) that provides a means of fastening a catch (83) on a cover (80).

The cover (80) is of a hexagonal plug-shaped design. A seat lock (81) on one end of the cover serves as the means of conjoining the cover (80) to the seat lock (73) of guide seat (70). On the top of the cover (80) is a curved hole (82) that holds the inserted cotter pin (90) and spring (91) which enable the cover (80) to be removed and replaced. On the other end of the cover is the catch (83). The catch (83) serves mainly to provide a means of interlocking with the securing tab (75) on the guide seat (70). This enables the cover (80) to be fitted onto the guide seat (70), while also preventing the accessories holder (60) from freely slipping out of the handle (20).

Based on the aforementioned description of the assembly that constitutes the multi-angle all-purpose screwdriver of the invention herein, the invention herein enables the screwdriver tools to be capable of countless multi-faceted and practical applications, while also raising the stature and added value of the product.

Referring now to the details indicated in the cross-sectional orthographic drawing of FIGS. 2A and 2B, the structural assembly of the invention herein firstly consists of a positioner plate (30) screwed onto the threaded section (23) of the handle (20). The threaded section (23) is such that the positioner plate (30) can be screwed down to the bottom of the threaded section (23), thereby securing the ratchet-angle locking plate (40) against the hinge tab (21) in the handle (20) and also securing the hinge tab (21) of the handle (20) inserted into the multi-angle ratchet wheel (12) of the screwdriver chuck (10), while the hinged section of the screwdriver chuck (10) thereby forms a pivotal joint that can be freely moved for adjustment up to 180 degrees. The nonslip rubber sleeve (26) fitted over the grip section (24) of the handle (20) enables the invention herein to be conveniently held in the hand and rotated. The accessories holder (60), nested inside the tubular space (25) inside the handle (20), is kept inserted by the guide seat (70) fitted firmly into the top of the handle (20), while the guide tabs (71) and (72) of the guide seat (70) are snugly inserted into the guide grooves (65) and (66) of the accessories holder (60), thereby allowing the accessories holder (60) to be structurally integrated and capable of free movement. The seat lock (81) of the cover (80), which is inserted into the seat lock (73) of guide seat (70), and a spring (91) which holds an inserted cotter pin (90), enable the cover (80) to be removable and replaceable. The catch (83) of the cover (80) latched firmly to the securing tab (75) on the guide seat (70) enables the cover (80) to be usefully removed and replaced.

Figure 3:
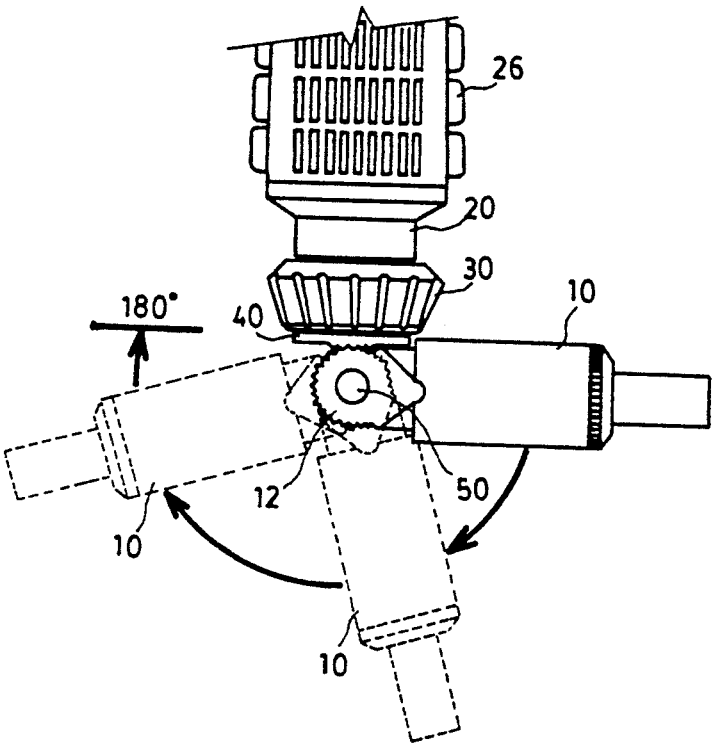
FIG. 3 is a drawing illustrating the operating mechanism of the invention herein.

With regard to the detailed structure of the invention herein, the entire assembly has been thoroughly explained, but in regards to the achieved "practical" effectiveness and produced "special functions" of the invention herein, these aspects consists mainly of:

1. The two serrated ramps of multi-angle ratchet wheel (12) on the screwdriver chuck (10) and hinged section of the handle (20) of the invention herein are conjoined to the handle (20) by the positioner plate (30) and the ratchet-angle locking plate (40). The positioner plate 30 and locking plate 40 adjust the angle of the screwdriver chuck (10) with respect to the handle (20). The positioner plate (30) also has the special function of applying the screw-on pressure that holds the toothed ridges (42) on the locking plate (40) enmeshed against the serrated ramps of multi-angle ratchet wheel (12) to achieve a locking effect. This configuration enables a variable angular adjustment range of different angles up to 180 degrees. Referring to the indications in FIG. 3, the loosening and tightening components are shown in dynamic phase to illustrate the special function of the mechanism.

Figure 4:
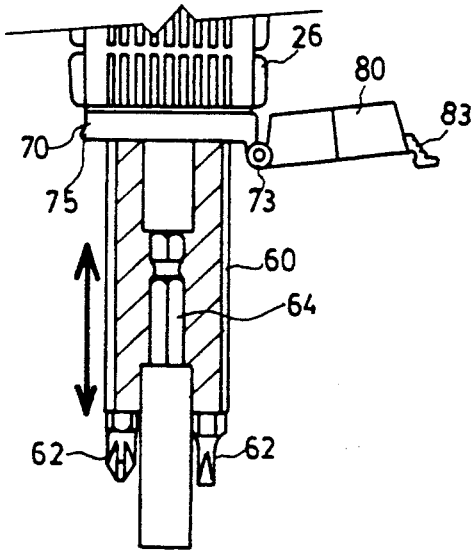
FIG. 4 is a drawing illustrating the operation of the invention herein.

2. The accessories holder (60) is ensconced inside the handle (20). Inserted into the accessories holder (60) are different size screwdriver tips (62) (screwdriver tools) and extension rod (64). The cover (80) is affixed to the handle (20) with a catch (83) latched to the securing tab (75). Therefore, in utilization, the thumb can be lightly pushed against the catch (83) to unfasten the securing tab (75) and thereby gain access to the accessories holder (60). The accessories holder (60) can be slipped out of the tubular space (25) within the handle (20), while still remaining inserted onto the guide seat (70). As indicated in FIG. 4, this enables the convenient exchanging of screwdriver tips (62) (screwdriver tools) and thereby constitutes a special function of the invention herein.

Figure 5:
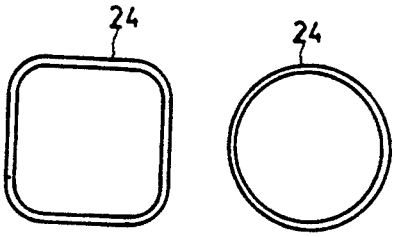
FIG. 5 is a drawing of possible shapes of the grip section of the invention herein.

To emphasize a final point, the grip (24) of the handle (20) of the invention herein is hexahedral in pursuit of the most ideal shape, however, the grip (24) may also be in the form of a round, square with rounded corners and the other suitable shapes, as indicated in FIG. 5. Furthermore, the matching assembly consisting of the nonslip rubber sleeve (26), the accessories holder (60), the guide seat (70), the cover (80) and other structural components can also be modified according to the shape of the handle (20), thereby illustrating and serving notice that the modification or embellishment of the invention herein shall not be construed as a device that is not subject to the scope of the invention herein.

From the foregoing description of the preferred embodiment of the invention, it will be apparent that many modifications may be made therein. It should be understood that these embodiments are intended as one example of the invention only, and that the invention is not limited thereto. Therefore, it should be understood that the appended claims are intended to cover all modifications that fall within the true spirit and scope of the invention.

What is claimed is:

1. A multi-angle all-purpose ratchet screwdriver comprising:

a screwdriver chuck having one end for holding different size fastener loosening tools and having another end formed as a U-shaped hinged section having two vertical arms formed with serrations which constitute a multi-angular ratchet wheel;

a handle having a hinge tab, a threaded section and grip section having a tubular space therein;

a positioner plate for screwing, securing and movement on the threaded section;

a ratchet-angle locking plate having a slot for inserting the hinge tab of the handle, and having two rows of toothed ridges which enmesh with said serrations;

a first connecting means for pivotally connecting said screwdriver chuck to said handle;

an accessories holder installed into the tubular space inside the handle for holding different size screw unfastening tools;

a seat guide secured onto an upper end of the grip section of the handle, and having a seat lock for insertion of a second connecting means, and having a securing tab; and a cover having a seat lock on one end to connect to the seat lock of said seat guide for holding the inserted second connecting means, which enable the cover to be removed and replaced, and the cover having a catch for interlocking with the securing tab on the seat guide to prevent the accessories holder from slipping out of the handle, wherein screw-on pressure produced by the positioner plate that is exerted on the toothed ridges on the ratchet-angle locking plate which are enmeshed with serrations of the multi-angle ratchet wheel allows firm adjustment over a varied range of angles.

2. A multi-angle all-purpose ratchet screwdriver according to claim 1 wherein the accessories holder, ensconced inside the tubular space of the handle for holding a screw unfastening tool.

3. A multi-angle all-purpose ratchet screwdriver according to claim 1 wherein the cover is a removable cover and wherein the accessories holder is slidable to slide out of the tubular space in the handle when said cover is removed.

4. A multi-angle all-purpose ratchet screwdriver according to claim 1 wherein the grip section of the handle has a shape of one of hexagonal, square, round, and square with rounded corners, and wherein the accessories holder, seat guide and cover with the handle having a shape according to the shape of the handle.

5. A multi-angle all-purpose ratchet screwdriver according to claim 1 further comprising a non-slip sleeve disposed on an outside surface of said grip section.

6. A multi-angle all-purpose ratchet screwdriver according to claim 1 wherein said grip section having securing tabs positioned in parallel juxtaposition on outer sides of said grip section, said securing tabs for insertion of said seat guide.

7. A multi-angle all-purpose ratchet screwdriver according to claim 1 wherein said ratchet-angle locking plate is disk shaped.

8. A multi-angle all-purpose ratchet screwdriver according to claim 1 wherein said first connecting means is a columnar shaft rod.

9. A multi-angle all-purpose ratchet screwdriver according to claim 1 wherein said accessories holder includes a plurality of troughs to hold said screw unfastening tools.

10. A multi-angle all-purpose ratchet screwdriver according to claim 9 wherein said troughs are semi-circular in shape.

11. A multi-angle all-purpose ratchet screwdriver according to claim 1 wherein said accessories holder includes guide grooves provided on right and left sides of a center line on sides of the accessories holder.

12. A multi-angle all-purpose ratchet screwdriver according to claim 11 wherein said seat guide has two oppositely positioned guide tabs located on an inside of said seat guide, said guide tabs for insertion into said guide grooves for alignment and tracking.

13. A multi-angle all-purpose ratchet screwdriver according to claim 1 wherein said second connecting means is a cotter pin and spring.

14. A multi-angle all-purpose ratchet screwdriver according to claim 1 wherein said positioner plate is conical with fluted exterior sides to increase surface friction and inside is threaded.

* * * * *